US007578629B2

(12) United States Patent
Kruijt

(10) Patent No.: US 7,578,629 B2
(45) Date of Patent: Aug. 25, 2009

(54) SHEET HANDLING DEVICE INCLUDING SUCTION CHAMBER WITH FLOW OBSTRUCTING MATERIAL

(75) Inventor: Pieter G. M. Kruijt, Eindhoven (NL)

(73) Assignee: Oce-Technologies B.V., Venlo (NL)

( * ) Notice: Subject to any disclaimer, the term of this patent is extended or adjusted under 35 U.S.C. 154(b) by 582 days.

(21) Appl. No.: 11/240,773

(22) Filed: Oct. 3, 2005

(65) Prior Publication Data

US 2006/0071998 A1 Apr. 6, 2006

(30) Foreign Application Priority Data

Oct. 4, 2004 (EP) ..... 04104857

(51) Int. Cl.
*B41J 2/01* (2006.01)
*B25B 11/00* (2006.01)

(52) U.S. Cl. ..... 400/645; 400/648; 347/104; 248/363; 269/21

(58) Field of Classification Search ..... 271/197, 271/90, 98, 106, 276; 400/645; 347/104; 198/689.1; 248/363; 269/21; *B41J 2/01, B41J 3/08, 3/12*

See application file for complete search history.

(56) References Cited

U.S. PATENT DOCUMENTS

| | | | | |
|---|---|---|---|---|
| 3,477,558 | A * | 11/1969 | Fleischauer | 198/689.1 |
| 5,141,212 | A * | 8/1992 | Beeding | 269/21 |
| 6,409,332 | B1 | 6/2002 | Yraceburu et al. | |
| 2002/0015610 | A1 * | 2/2002 | Beehler et al. | 400/701 |
| 2002/0046667 | A1 * | 4/2002 | Frankenberger et al. | 101/232 |
| 2002/0067403 | A1 | 6/2002 | Smith | |

FOREIGN PATENT DOCUMENTS

EP 0 997 308 A2 5/2000

* cited by examiner

*Primary Examiner*—Leslie J Evanisko
(74) *Attorney, Agent, or Firm*—Birch, Stewart, Kolasch and Birch, LLP

(57) ABSTRACT

A sheet handling device containing a sheet support element having a surface provided with suction holes which are connected to at least one suction chamber, the suction chamber being connected to a suction device adapted to create a sub-atmospheric pressure in the suction chamber, and a flow obstructing material arranged to obstruct an air flow from at least a subset of the suction holes into the suction chamber.

7 Claims, 3 Drawing Sheets

SHEET HANDLING DEVICE INCLUDING SUCTION CHAMBER WITH FLOW OBSTRUCTING MATERIAL

BACKGROUND OF THE INVENTION

The present invention relates to a sheet handling device, comprising a sheet support element, said element having a surface comprising suction holes which are connected to at least one suction chamber, said suction chamber being connected to a suction device adapted to create a subatmospheric pressure in the suction chamber.

In the copying and printing industry, a sheet support element with suction holes is frequently used for supporting an image receiving sheet and at the same time ensuring that the sheet lies perfectly flat on the support element. For example, in an ink jet printer, a sheet, e.g., a sheet of paper, is advanced over a sheet support plate while the image is being printed. The sheet is held on the sheet support plate due to the subatmospheric pressure in the suction chamber which is connected to suction holes facing the bottom side of the sheet. A certain subatmospheric pressure is required to hold the sheet sufficiently flat on the support plate.

When sheets of different width are to be printed, the smaller sheets do not cover the sheet support element completely. Therefore, some of the suction holes are not covered. When the suction chamber is made of one large compartment extending over the whole area of the sheet support element, an air flow through the not covered suction holes leads to an increase of the pressure in the suction chamber. This results in the sheet not being held firmly on the support element. If, on the other hand, a suction device of higher power is used to compensate for the increased air flow into the suction chamber, the suction will be too strong when all suction holes are covered by a large sheet, and the advance of the sheet over the support element is impeded.

From the European patent application EP 0 997 308 A2 a media hold down unit is known that comprises two or more vacuum chambers, a first vacuum chamber being directly connected to a vacuum source, while the other vacuum chambers are each connected to the vacuum source via separate bypass channels. The sizes of the chambers correspond to different widths of sheets that are to be handled. If one of the chambers is not covered by a sheet, an air flow is generated from this chamber through the bypass channel. The air flow affects the uniformity of the pressure inside the first vacuum chamber. Since the bypass channel and the first vacuum chamber are connected at an entrance into a conduit leading to the vacuum source, the uniformity of the pressure provided at the first chamber is affected only to a reduced extent. However, only a limited number of different sheet widths can be handled. Furthermore, for each partition of the support plate an extra bypass channel is needed and requires extra space.

SUMMARY OF THE INVENTION

It is an object of the present invention to provide a sheet handling device in which sheets of different sizes can be held down on a sheet support element with appropriate suction pressure, the sheet handling device being of simple and space saving construction.

According to the present invention, this object is achieved by a sheet handling device of the type indicated above, wherein a flow obstructing material is arranged to obstruct an air flow from at least a subset of the suction holes into the suction chamber.

For example, the flow obstructing material may fill passages that run through the sheet support element and connect the suction holes to the suction chamber. In a different example, the flow obstructing material may build one or more blocks that are arranged in the suction chamber to lie against apertures of the sheet support element which are connected to the suction holes.

For example, the flow obstructing material is arranged to obstruct air flow from only those suction holes which are positioned outside a predetermined area of the sheet support element. This predetermined area is, for example, a rectangular area having a width that is approximately equal to the width of a smallest sheet that is to be handled, for example, an A4 size sheet. When a sheet is placed over this area of the sheet support element, it will sucked onto the sheet support element, and a subatmospheric pressure in the suction chamber will hold the sheet flat to the sheet support plate. There is also an air flow through those suction holes which are not covered by the sheet. However, this air flow is reduced by the flow obstructing material. Due to the resulting pressure difference over the flow obstructing material, the subatmospheric pressure necessary to hold down the sheet can be maintained in the suction chamber.

When, however, a sheet of larger size covers also the suction holes for which the flow path is obstructed, the flow rate will be reduced substantially. Thus, the effect of the flow resistance of the flow obstructing material will also be reduced, and the suction effect will be essentially uniform over the whole area of the sheet.

Although the present invention can be used with a single compartment suction chamber, it does not suffer from the drastic pressure variations with varying media sheet widths, as is the case with conventional single compartment suction chambers. Furthermore, the present invention allows to use a single suction chamber for handling sheets the width of which may vary continuously or discretely within a wide range. The invention is also applicable for sheet support elements having a curved surface.

In a preferred embodiment, the flow obstructing material is arranged in a region of the suction chamber where the suction holes of at least said subset are connected to the suction chamber. For example, the flow obstructing material may be arranged in two blocks extending over lateral parts of the suction chamber, whereby the middle part of the suction chamber does not contain the flow obstructing material. This middle part will then have a width that is not larger than the width of the smallest sheets to be handled.

Preferably, the flow obstructing material is arranged to obstruct an air path between any two suction holes of at least said subset of suction holes. For example, the subset of suction holes may comprise all suction holes within a certain area of the sheet support element. Alternatively, there may be direct air paths between rows of suction holes, while the airflow from such a row of suction holes to the suction device is obstructed by the flow obstructing material.

In one embodiment, the flow obstructing material may completely cover a wall of the suction chamber containing apertures which are connected to the suction holes. In this embodiment, the airflow from the suctions holes to the suction device is also reduced when no sheet is present on the sheet support element.

In a specific embodiment, the flow obstructing material is arranged to provide obstructed air flow paths of different lengths between the different suction holes and the suction device. The flow obstructing material may be provided, for example, as one or more blocks of varying thickness being arranged adjacent to apertures that are connected to the suction holes. Thereby, a certain amount of flow leakage, depending on the size of the area that is covered by a sheet, can be provided by adapting the shape of the flow obstructing material.

The sheet support element may be a plate that has at least one hollow space formed between a top wall defining the top surface of the plate and a bottom wall defining a bottom surface of the plate, wherein the suction holes pass through the top wall from the top surface to the hollow space. The hollow space is connected to the suction chamber and at least a part of the flow obstructing material fills at least a part of the hollow space. For example, a plurality of hollow spaces may connect respective rows of suction holes and may be filled completely or partially by the flow obstructing material.

BRIEF DESCRIPTION OF THE DRAWINGS

Preferred embodiments of the present invention will now be described in conjunction with the drawings, in which.

DETAILED DESCRIPTION OF THE INVENTION

Figure 1:
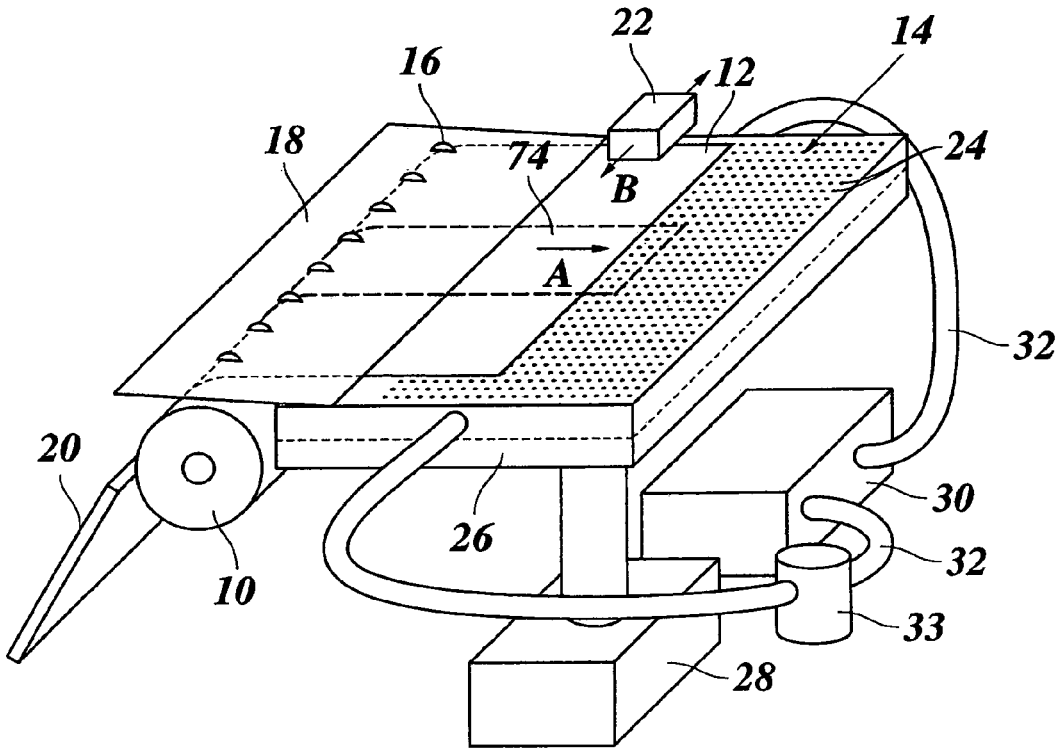
FIG. 1 is a schematic perspective view of a hot-melt ink jet printer.

As is shown in FIG. 1, a hot melt ink jet printer comprises a platen 10 which is intermittently driven to rotate in order to advance a sheet 12, e.g., a sheet of paper, in a direction indicated by an arrow A over the top surface of a sheet support plate 14. A number of transport rollers 16 are rotatably supported in a cover plate 18 and form a transport nip with the platen 10, so that the sheet 12, which is supplied from a reel (not shown) via a guide plate 20, is paid out through a gap formed between an edge of the cover plate 18 and the surface of the sheet support plate 14.

A carriage 22 which includes a number of ink jet printheads (not shown) is mounted above the sheet support plate 14 so as to reciprocate in the direction of arrows B across the sheet 12. In each pass of the carriage 22, a number of pixel lines are printed on the sheet 12 by means of the printheads which eject droplets of hot melt ink onto the sheet in accordance with image information supplied to the printheads. For the sake of simplicity, guide and drive means for the carriage 22, ink supply lines and data supply lines for the printheads, and the like, have not been shown in the drawing.

The top surface of the sheet support plate 14 has a regular pattern of suction holes 24 which pass through the plate and open into a suction chamber 26 that is formed in the lower part of the plate 14. The suction chamber is connected to a blower 28 which creates a subatmospheric pressure in the suction chamber, so that air is drawn-in through the suction holes 24. As a result, the sheet 12 is held against the flat surface of the support plate 14 in a flat condition, especially in the area which is scanned by the carriage 22. Thereby, a uniform distance between the nozzles of the printheads and the surface of the sheet 12 is established over the whole width of the sheet and a high print quality can be achieved.

The droplets of molten ink that are jetted out from the nozzles of the printheads have a temperature of 100° C. or more and cool down and solidify after they have been deposited on the sheet 12. Thus, while the image is being printed, the heat of the ink must be dissipated at a sufficient rate. On the other hand, in the initial phase of the image forming process, the temperature of the sheet 12 should not be too low, because otherwise the ink droplets on the sheet 12 would be cooled too rapidly and would not have time enough to spread-out. For this reason, the temperature of the sheet 12 is controlled via the sheet support plate 14 by means of a temperature control system 30 which circulates a temperature control fluid, preferably a liquid, through the plate 14. The temperature control system includes a circulating system with tubes 32 that are connected to opposite ends of the plate 14. One of the tubes passes through an expansion vessel 33 containing a gas buffer for absorbing temperature-dependent changes in the volume of the liquid. As will be readily understood, the temperature control system 30 includes heaters, temperature sensors, heat sinks, and the like for controlling the temperature of the fluid, as well as a pump or other displacement means for circulating the fluid through the interior of the sheet support plate 14.

Figure 2:
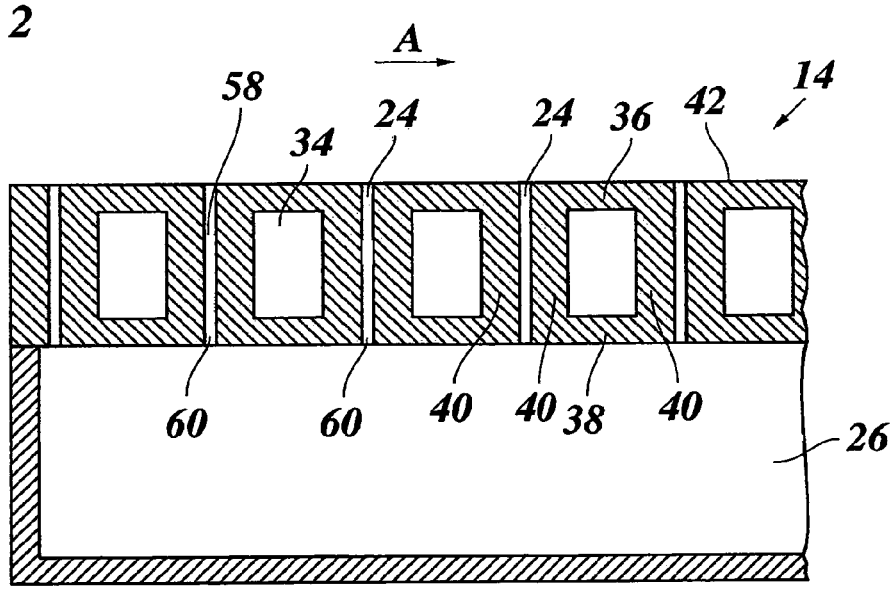
FIG. 2 is a partial, longitudinal section of a sheet support plate in the printer shown in FIG. 1.

As is shown in FIG. 2, a number of elongated cavities 34 are formed in the interior of the plate 14 so as to extend in parallel with one another and in parallel with the direction (B) of travel of the carriage 22 between opposite ends of the plate 14, where they are connected to the tubes 32 through suitable manifolds. The cavities 34 are delimited by top walls 36, bottom walls 38 and separating walls 40. The top walls 36, together, define the top surface 42 of the plate 14 which is machined to be perfectly flat.

Within the separating walls 40, passages 58 connect the suction holes 24 to apertures 60 at a bottom surface of the bottom wall of the plate 14. In FIG. 2, the section is parallel to the direction (A) of the sheet advance.

Figure 3:
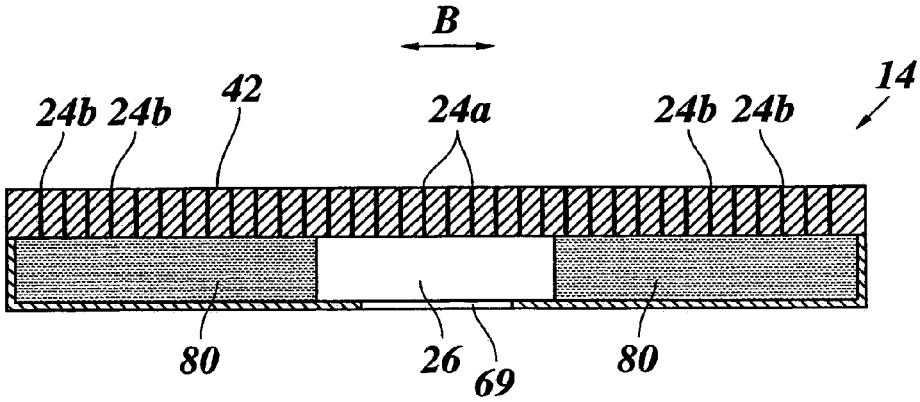
FIGS. 3 to 5 are schematic cross-sections of different embodiments of the sheet support plate of FIGS. 1 and 2.
Figure 4:
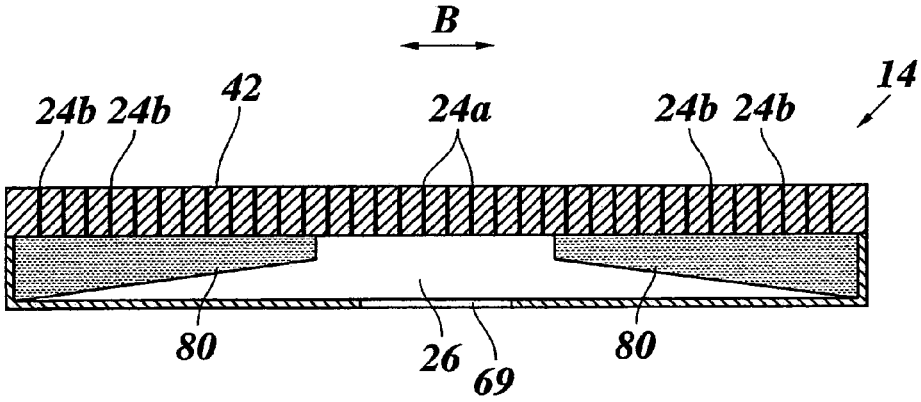
Figure 5:
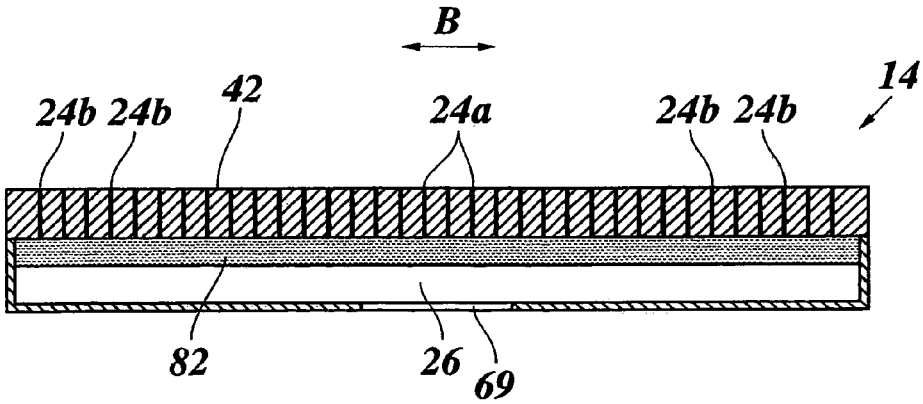

In FIGS. 3, 4 and 5, different embodiments of the sheet support plate 14 are shown in cross-section, the plane of section being parallel to the arrows B in FIG. 1. The dimensional proportions and the number of the suction holes 24 as shown have been altered for reasons of clarity.

In the embodiment shown in FIG. 3, a flow obstructing material is arranged in two blocks 80 that extend over the left and right part of the suction chamber 26. A middle part of the suction chamber 26 is connected to the suction device through an opening 69. The width of this middle part of the suction chamber 26 is approximately equal to the width of the smallest sheet that is to be handled, for example an A4 size sheet. When an A4 size sheet 74 (FIG. 1) is placed in a central position on the sheet support plate 14, the suction holes 24 of a first subset 24*a* will be covered. Suction holes of a second subset 24*b* which are positioned above the blocks 80 of flow obstructing material remain uncovered. However, a larger sheet, for example sheet 12 of FIG. 1, may cover the suction holes of both subsets 24*a* and 24*b*.

The blocks 80 are made of a material that is air-permeable but presents a certain flow resistance, e.g., an open-cell foam, a fiber blanket or some kind of cloth.

The shape of the blocks 80 may be adapted to create a certain amount of air flow leakage from not covered suction holes 24*b* to the blower 28, depending on the size of the sheet.

FIG. 4 shows an embodiment in which the blocks 80 have the shape of wedges.

In the embodiments of FIGS. 3 and 4, the air flow resistance increases with the distance of the suction holes 24*b* from the central portion of the plate, approximately linearly in FIG. 3 and progressively in FIG. 4. Thus, for a given power of the blower 28, the suction effect on sheets of any size is controlled such that the sheet will smoothly engage the surface 42 of the plate 14 but can nevertheless be readily advanced.

FIG. 5 shows an embodiment where the flow obstructing material is a fiber blanket 82 that is arranged beneath all the suction holes 24. The fiber blanket 82 which extends over the full area of the sheet support plate 14 and is of approximately constant thickness.

Figure 6:
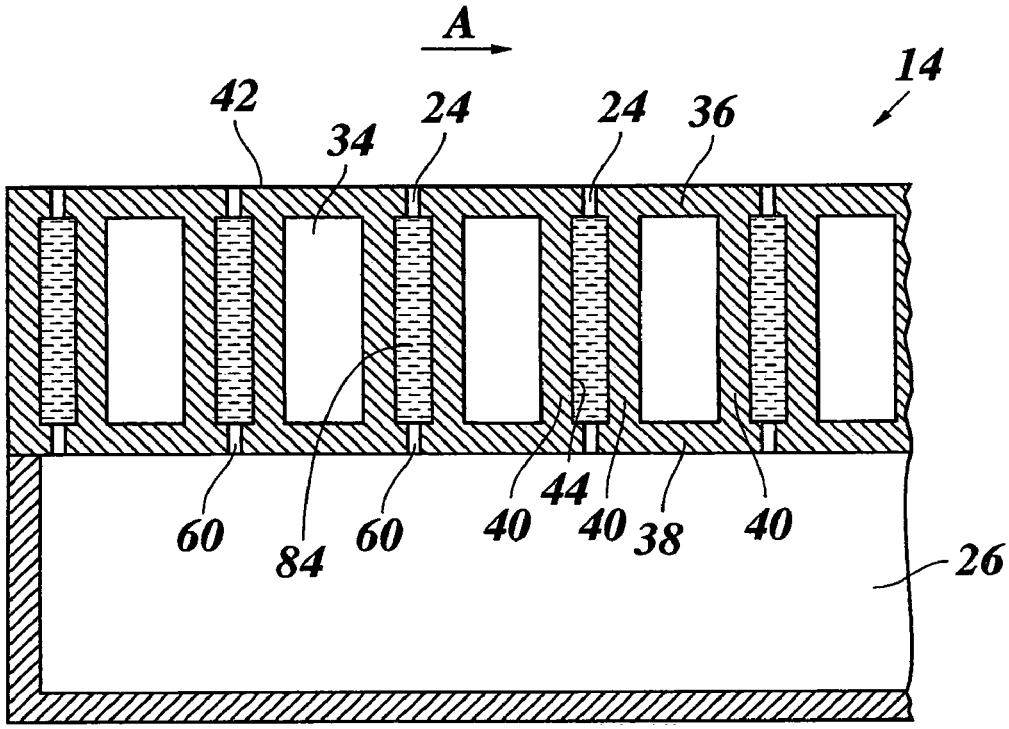
FIG. 6 is a partial cross-section of a further embodiment of a sheet support plate in the printer shown in FIG. 1.

FIG. 6 shows another embodiment of the sheet support plate 14, which differs from the sheet support plate of FIG. 1 in that there are hollow spaces 44 formed between pairs of separating walls 40. The hollow spaces 44 extend in parallel to each other and in parallel with the direction (B) of travel of the carriage 22 between opposite ends of the plate 14. The suction holes 24 pass through the top wall 36 into the hollow space 44. The hollow spaces 44 are connected to the suction chamber 26 via the apertures 60. The hollow spaces 44 are filled with flow a obstructing material 84. The suction chamber 26 does not contain flow obstructing material. Alternatively, flow obstructing material may also be present inside the suction chamber 26 as has been described in the previous embodiments.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A sheet handling device which comprises a sheet support element, said element having a surface containing suction holes communicating with at least one suction chamber, said suction chamber being connected to a suction device adapted to create a subatmospheric pressure in the suction chamber, wherein a flow obstructing material is arranged to obstruct the air flow through at least a subset of the suction holes which communicate with the suction chamber, said flow obstructing material being air-permeable but affecting an air flow resistance by defining obstructed air flow paths of difference lengths between different suction holes and the suction device.

2. The sheet handling device of claim 1, wherein the flow obstructing material is an open-cell foam.

3. The sheet handling device of claim 1, wherein the flow obstructing material is arranged in the suction chamber.

4. The sheet handling device of claim 3, wherein the flow obstructing material is arranged only in those parts of the suction chamber that are connected to suction holes which will only be covered by large-size sheets.

5. The sheet handling device of claim 4, wherein the flow obstructing material is formed by blocks having a non-uniform thickness.

6. A printer containing the sheet handling device of claim 1.

7. The printer of claim 6, wherein said printer is a hot-melt ink jet printer.

* * * * *